US005603494A

United States Patent [19]

Baker et al.

[11] Patent Number: 5,603,494

[45] Date of Patent: Feb. 18, 1997

[54] SHEET MAILBOX HAVING A ROTATABLE SHEET DISTRIBUTOR

[75] Inventors: William D. Baker; George M. Cross; Louis A. Rossi; Mark Spitler, all of Irvine; Frederick J. Lawrence, Tustin, all of Calif.

[73] Assignee: Gradco Ltd., Japan

[21] Appl. No.: 557,399

[22] Filed: Nov. 13, 1995

[51] Int. Cl.[6] ..... B65H 39/10

[52] U.S. Cl. ..... 271/296; 271/303

[58] Field of Search ..... 271/292, 296, 271/302, 303, 314; 74/66

[56] References Cited

U.S. PATENT DOCUMENTS

| | | | |
|---|---|---|---|
| 3,315,957 | 4/1967 | Mazzio et al. | 271/296 |
| 4,378,110 | 3/1983 | Greene et al. | 271/292 |
| 4,650,177 | 3/1987 | Hauger et al. | 271/303 X |
| 5,078,385 | 1/1992 | Serita | 271/296 |
| 5,131,644 | 7/1992 | DuBois | 271/303 |
| 5,503,381 | 4/1996 | Weber et al. | 271/303 X |

FOREIGN PATENT DOCUMENTS

| | | | |
|---|---|---|---|
| 65447 | 5/1977 | Japan | 271/303 |
| 254460 | 11/1986 | Japan | 271/303 |
| 81757 | 3/1989 | Japan | 271/303 |
| 310248 | 12/1990 | Japan | 271/296 |
| 279157 | 12/1991 | Japan | 271/303 |
| 148763 | 5/1992 | Japan | 271/303 |
| 286627 | 11/1993 | Japan | 271/303 |
| 19090 | 4/1899 | Switzerland | 74/66 |

OTHER PUBLICATIONS

Bevil et al. "Removable Collator Bins" Dec. 1976, vol. 19, No. 7, p. 2442.

*Primary Examiner*—Boris Milef
*Attorney, Agent, or Firm*—Newton H. Lee, Jr.

[57] ABSTRACT

A sheet receiving sorting device or mailbox has a sheet infeed including a short, pivoted distributor to direct sheets from the infeed, selectively or in sequence, to the input ends of an array of sheet guides extending at angles radiating from the center of the infeed outwardly to the inlet ends of a vertical stack of trays. At the sheet infeed ends of the trays are drive rolls for carrying the sheets into the trays depending upon the positioning of the distributor with respect to the array of sheet guides. The frame structure enables removal of the guides for sheet jam removal.

4 Claims, 4 Drawing Sheets

28a.
28b
31
30
11
29
28
27
26
M1
-G-
-32-
44
43
50
45
47a
47
36

48a
48
46
44
43
50
6
23
24
M2
22
25

SHEET MAILBOX HAVING A ROTATABLE SHEET DISTRIBUTOR

BACKGROUND OF THE INVENTION

Sheet receiving sorting machines useful for random distribution of sheets supplied from a copying or printing machine to a set of trays are generally complicated devices involving mechanisms for driving a sheet infeed system from tray to tray and/or costly due to the provision of gating devices for randomly removing sheets from a sheet transport system for carrying incoming sheets to selected trays. Such gate type sorters or mailboxes are usually fairly large, depending upon the number of trays and the nature of the sheet transporting systems.

Also moving infeed sorting devices associated with fixed trays sometimes impede the output speed of the host machine in order to appropriately transport successive sheets or designated selected trays when the space or gap between sheets or documents is small, and, in addition, such devices may be subject to sheet jamming in the distribution system for directing sheets to the appropriate trays.

THE PRIOR ART

In Lawrence U.S. Pat. No. 4,691,914 issued Sep. 8, 1987, there is shown one version of fixed bin sheet sorting or mailbox apparatus in which a set of vertically spaced, horizontally extended trays are adapted to receive sheets in succession or in random order by deflecting sheets into the selected tray from a vertically extended sheet feed path formed by cooperative sheet transport or feed rolls by shifting of nip rolls at selected gates by means of a plurality of solenoids. In such a construction the feed rolls and nip rolls assure movement of the sheets into the trays.

Examples of receivers of the type having a pivoted infeed device for distributing sheets selectively to an array of trays radiating from approximately the center of pivotal movement of the infeed are shown in U.S. Pat. No. 5,141,222 issued Aug. 25, 1992 to Saivada et al and U.S. Pat. No. 4,830,358 issued May 15, 1989 to Fazio et al. In such devices, infeed rolls are provided at the end of the pivoted distributor to feed sheets into the selected tray, so that moving or indexing of the infeed from one tray to any other tray must await completion of the delivery of a previous sheet, thereby inhibiting sheet distribution rate and requiring indexing or pivotal movement of a complex driven sheet feeding mechanism as part of the distributor. Such devices render sheet jam removal complex.

In order to avoid the need for shifting or indexing a driven infeed mechanism, as shown in prior German patent publication DE 44 26824 A1 of Feb. 23, 1995 of Rutishauser, a set of vertically spaced trays have sheet infeeds formed by an infeed roll and a surface of one of a plurality of webs which extend from the trays, between an infeed roll set below the trays and are mounted in fanned relation for pivotal movement on a support, so that the webs combine to form guides between the sheet transport webs and rolls and the entrance feed rolls at the lower ends of the webs. Such a web feeding construction and fanned arrangement inherently is complicated and difficult to service or remove sheet jams. It also requires pivotal movement of the guide system with respect to the trays and extension of the guides across the entire height of the inlet ends of the trays.

SUMMARY OF THE INVENTION

The present invention provides a sheet sorting or mailboxing receiver for the sheet output from a printer or other copy producing device which avoids much of the complexity and costs of the prior, known devices which is of simple construction, not readily susceptible of sheet misfeed or jams, but yet easy to use and remove jams when they occur.

More particularly, the invention utilizes a combination of a set of trays having, at the inlet ends, infeed rolls for assuring delivery of a sheet into a selected tray, either randomly or in succession, from a stationary sheet guide associated with each tray and to which sheets are individually distributed by a simple pivoted sheet distributor disposed between ends of the guides and a sheet infeed for delivering the lead ends of the sheets into a selected guide.

Specifically, the distributor is short and is readily pivotally shiftable through a small arc to selected positions to distribute the sheets to the guides which are fanned radially from the approximate center of the pivotal movement of the distributor and deliver the sheets to the inlet ends of the trays along a substantially vertically extended plane defined by the infeed rolls at the inlet ends of the trays, and the trays extending horizontally, in parallel relation. Since the distributor is not required to transport sheets, it is easy to actuate, and, also, the guides are not required to transport the sheets, so that when the trailing edges of a sheet is in a guide, the distributor can be shifted to another selected guide for the delivery of a following sheet to the next selected tray so as to enable high speed operation in the case of short inter-document gap.

In addition, the construction is such that access to the interface between the distributor and the guides and to the interface between the guides and the infeeds for the trays is made simple for purposes of jam removal, when it occurs, even though the construction is conducive to avoidance of jam frequency.

Other features and advantages of the invention will be hereinafter described or will become recognized by those skilled in the art upon reference to the accompanying drawings forming a part hereof.

DESCRIPTION OF THE PREFERRED EMBODIMENT

Figure 1:
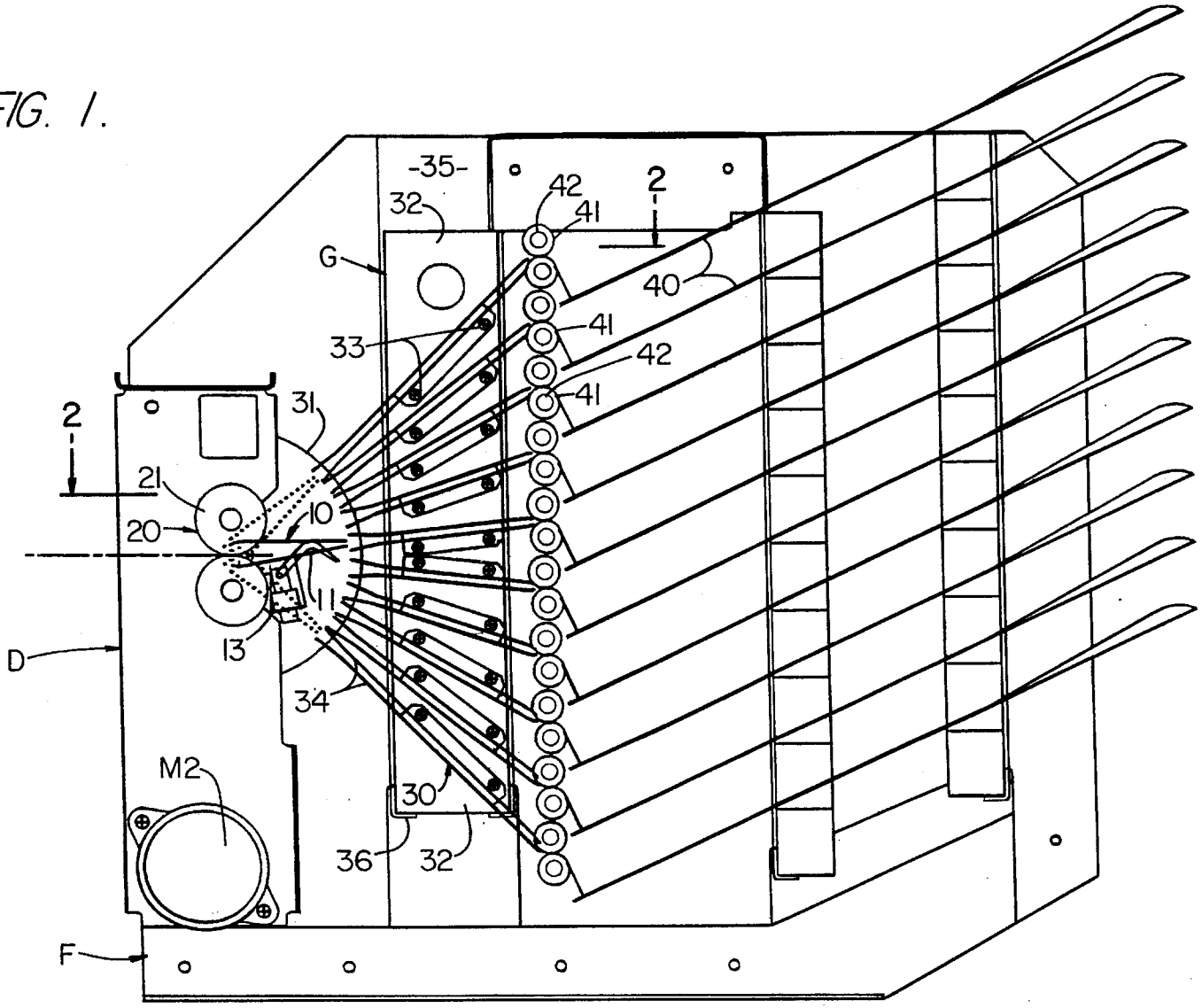
FIG. 1 is a longitudinal section showing the details of a sheet receiver made in accordance with the invention.
Figure 2:
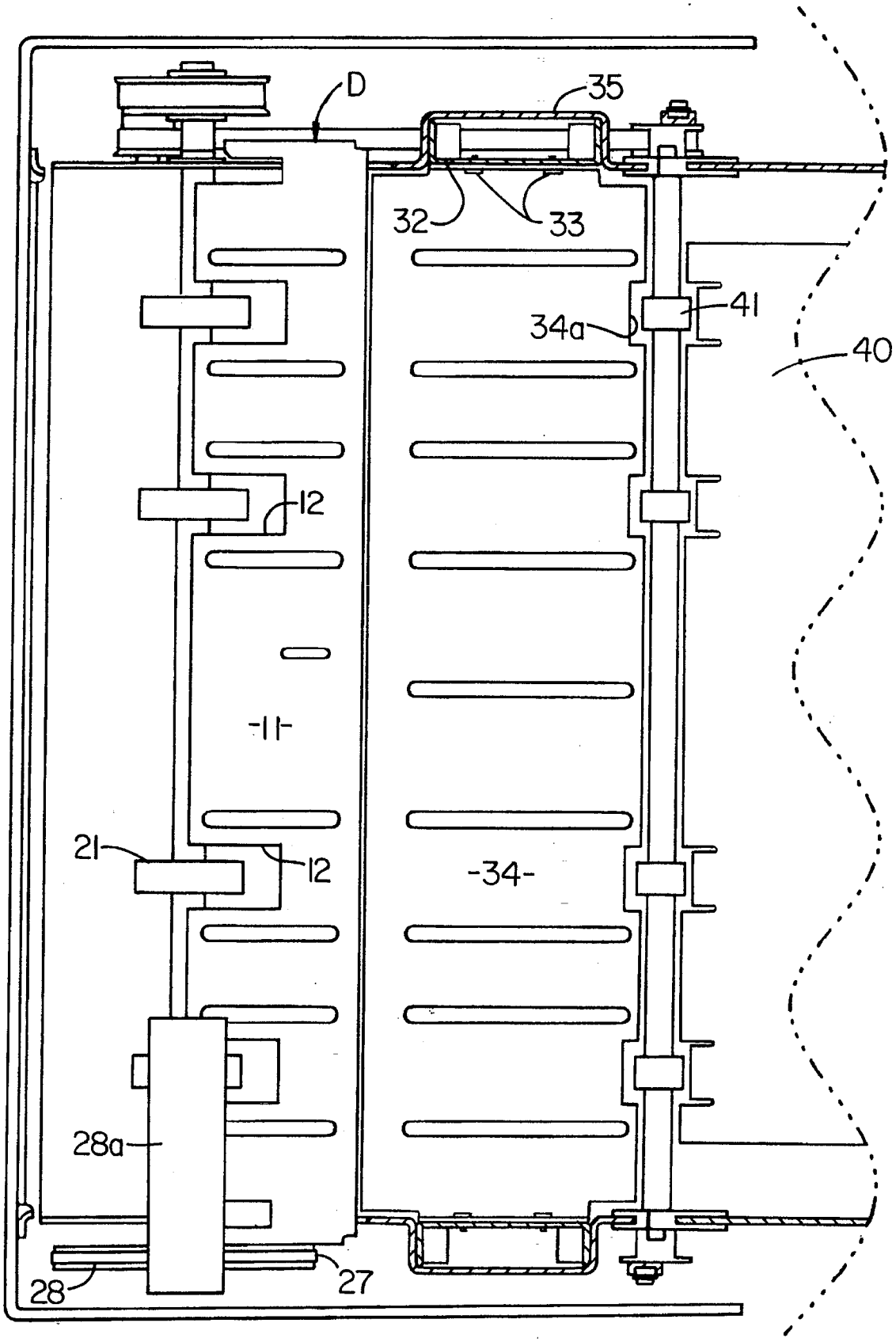
FIG. 2 is a view in horizontal section on the lines 2—2 of FIG. 1.

As seen in the drawings, referring first to FIGS. 1 and 2, the sheet receiving apparatus of the invention has a frame structure F. Incorporated in the frame structure are three sub-assemblies including a distributor section D, a guide section G and a receiving tray section T.

The distributor section D has a sheet distributor 10 adapted to receive sheets fed into the distributor by sheet infeed means 20 and to be moved angularly by a motor M1 between the full line position of FIG. 1 and the two broken line positions. The motor is so controlled as to move the distributor in increments to any selected angular position throughout its range of movement to position the distributor for directing a sheet into one of a plurality of sheet guides 30 at the sheet guide section G.

The guide section D has, as indicated, a set of sheet guides 30 fanning from inner ends 31 which are preferably slightly flared for facilitating entry of the leading edge of a sheet into a selected guide 30. At the other end of the respective guides, they are spaced further apart so as to direct sheets guided thereby towards a tray 40 of the tray section T.

The tray section T has a substantially vertically spaced set of trays 40 extending horizontally and preferably at a slight incline to receive sheets directed into the trays from the guides, depending upon the angular position of the distributor 10 with respect to the inlet ends 31 of the guides 30 when a sheet is fed by the infeed means 20 into the distributor. At the sheet inlet ends of trays 40, into which sheets pass from the guides, are sets of driven feed rolls 41 and companion friction rolls 42 for receiving the leading edge of a sheet from a guide 30 and feeding the sheet into the tray 40.

From the foregoing, it will be recognized that the apparatus is adapted to easily enable feeding sheets to trays 40 which occupy a relatively large vertical space, by a full range of angular movement of the distributor, which is short compared to the spacing between trays, by reason of the fanned guides which bridge the short vertical range of movement of the distributor to the substantially greater vertical spacing between trays.

For a better understanding of the details of construction of the apparatus, it will be seen that the distributor 10 includes a pair of plates 11 which extend transversely of the frame F and have notches 12 into which respective infeed rolls 21 of the infeed means 20 extend to assure proper entry of the leading edges of the sheets into the distributor 10.

Passage of a sheet into and through the distributor is detected by a paper detector switch 13 which controls operation of distributor motor M1.

Figure 4:
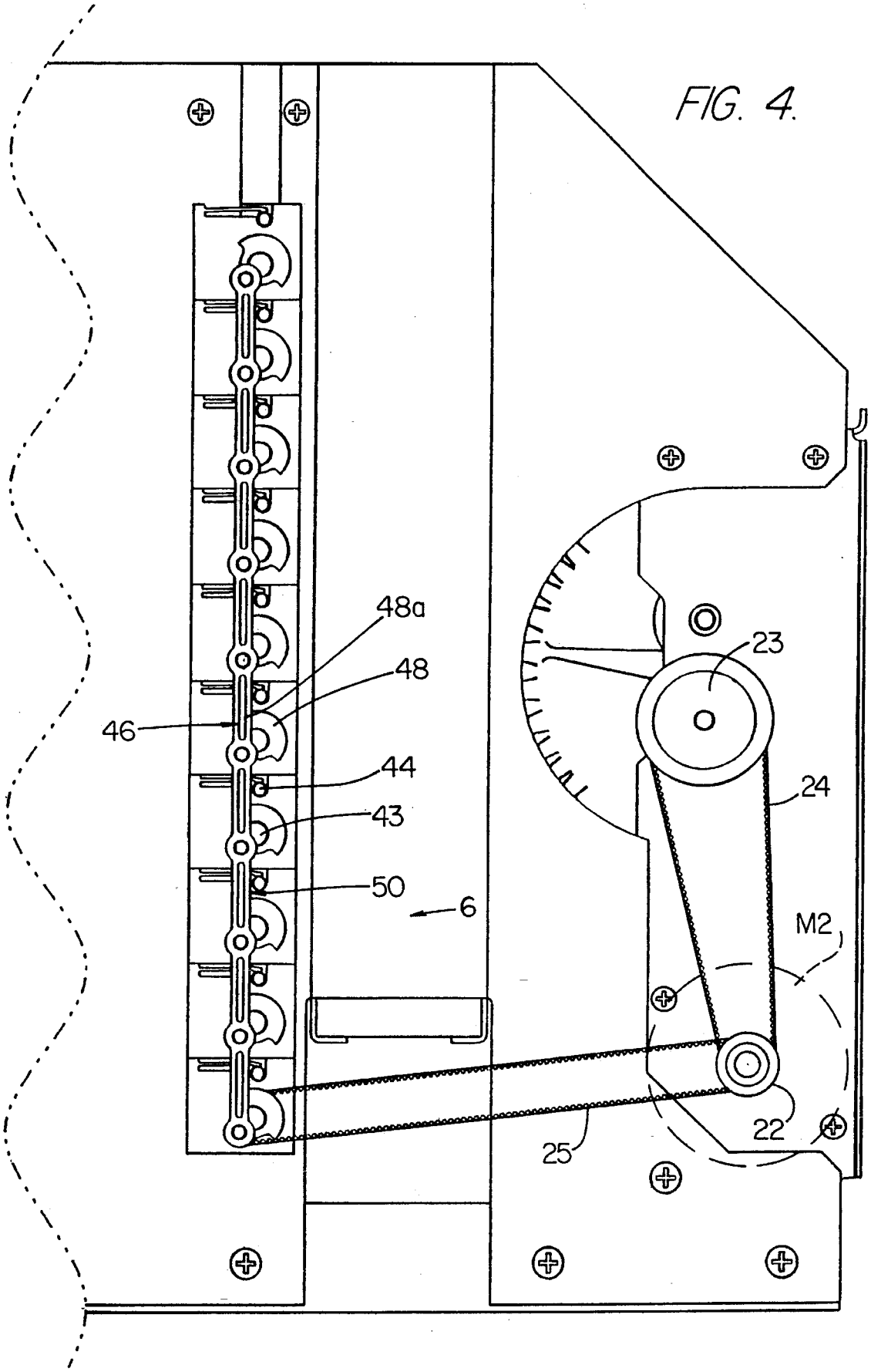
FIG. 4 is a fragmentary view of the opposite side of the receiver of FIG. 1, showing the distributor infeed drive and drive to the tray infeed roll drive means.

Infeed rolls 21, as seen in FIG. 4, are driven by a suitable motor M2 through pulleys 22 and 23 and a drive belt 24. Pulley 22, through another belt 25 extending beneath guide section G, also drives the lowermost driven roll 41 of the infeed roll sets 41, 42 for carrying sheets into the trays 40. The entire infeed roll set at the inlet ends of the respective trays is driven in unison by drive means 50 which effect a common drive. Such drive means 50 will be hereinafter described.

Motor M1 drives a pulley 26 and a belt 27 drives a rotary support disc 28 to which the distributor 10 is connected, as by fasteners 29, for angular movement responsive to energization of motor M1 to cause driving of disc 28 in either direction and through ranges of motion or increments of motion as determined by a controller for motor M1, to position the distributor 10 for delivery of the leading edge of a sheet into an appropriate guide 30 and then, through the guide, to the tray sections and to infeed rolls 41, 42 responsive to the drive from infeed rolls 21, to an appropriate tray 40.

Figure 3:
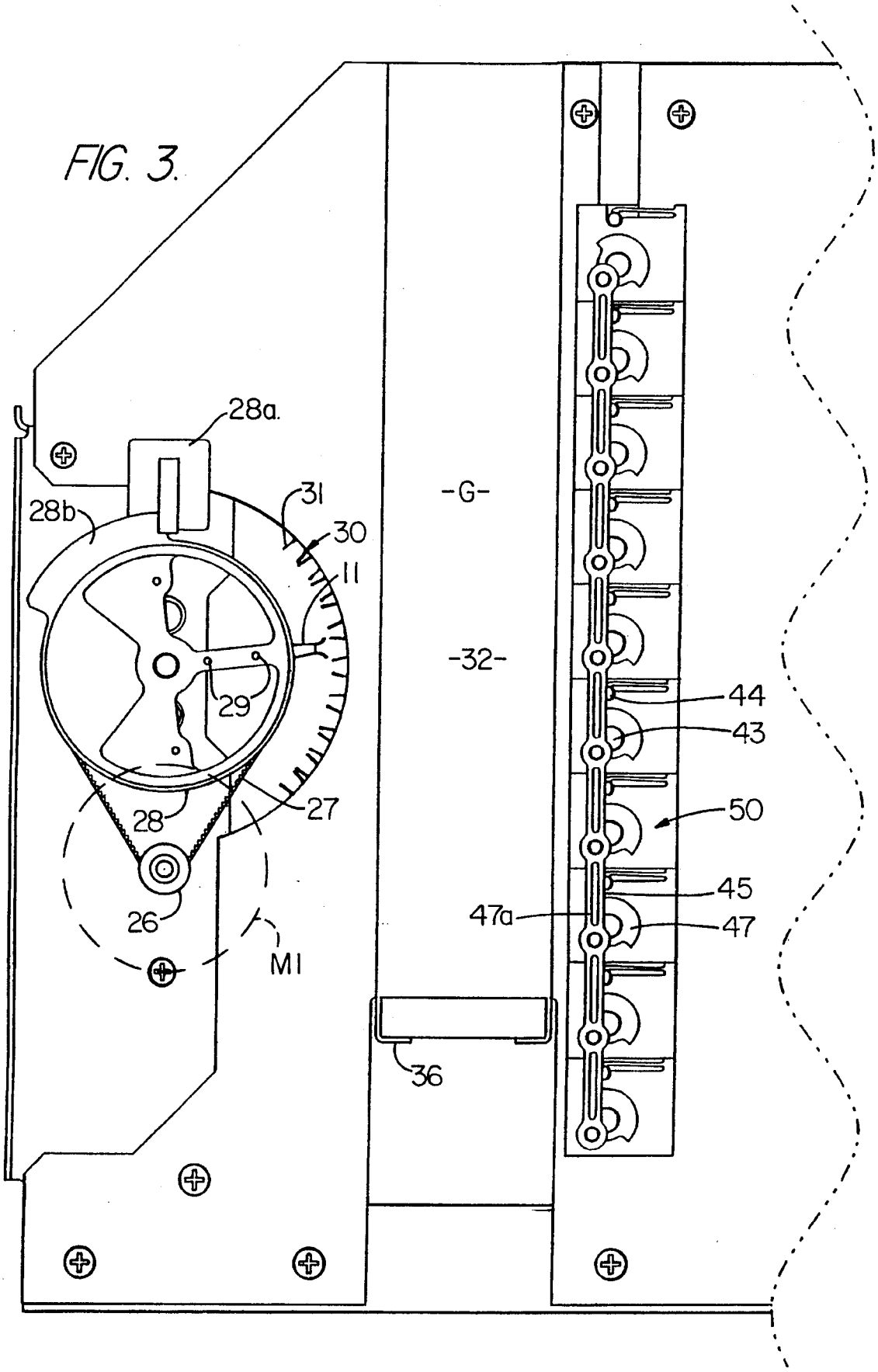
FIG. 3 is a fragmentary view of one side of the receiver of FIG. 1, showing distributor and tray infeed roll drives.

An optical sensor **28*a* is positioned at the periphery of the distributor support disc 28 and a circumferentially extended member 28*b* on the disc 28 is employed to cause the detector 28*a* to sense the positioning of the distributor 10 in the home position as seen in FIGS. 1 and 3. The detector 28*a* cooperates with the controller for motor M1 so as to cause the angular excursions of the distributor 10 from the home position, in full lines of FIG. 1**, to the respective angularly offset positions shown in broken lines therein.

The guide section G includes a pair of side plates 32 between which extend the fanned guides 30. At opposite ends the guides 30 are connected as by fasteners 33 to the side plates 32. Each guide 30 comprises a pair of guide plates 34 extending generally radially with respect to the center of angular movement of the deflector 11 at the flared inlet ends 31 of the guides and extending, as previously indicated, to positions adjacent each tray or set infeed rolls 41, 42, so that as a sheet is fed into the space between the guide plates 34, the lead edge of the sheet is directed to the nip between rolls 41 and 42 of the respective trays.

Inasmuch as access to the apparatus for removal of jammed sheets is necessary, the side plates 32 of the guide section are slidably and vertically disposed in channels 35 provided at each side of the frame structure thereby facilitating vertical removal of the guide assembly from the seat 36 on which the side plates 32 are adapted to rest. Plates 34 have notches **34*a* for enabling the ends of the guides adjacent to the feed rolls 41, 42 to bypass the peripheries of the feed rolls, but the portions of the plates 34 direct the leading edges of the sheets to the nip between the rolls 41, 42**.

Drive means 50 for the tray infeed rolls 41, 42 are seen in FIGS. 3 and 4, and, as previously described, include the drive motor M2 which drives both the end feed rolls set 21 and the tray infeed rolls. The infeed rolls 41 are mounted on transversely extended driven shafts 43 journaled in the sides of the frame and interconnected by drive means which cause the shafts 43 to rotate in unison, and nip rolls 42 are rotatable on transversely extended shafts 44 for fuctional drive of the paper through rolls 41 and 42.

Such drive means 50 may be in the form of gear sets (not shown) driven by shafts 43 and inner gears interposed therebetween and adapted to drive shafts 44 on which the rolls 42 are mounted, as is well known. However, as here shown, shafts 42 are interconnected for simultaneous drive by locomotive type links 45 and 46 at opposite sides of the assembly and wheels 47 and 48 to which drive links **47*a* and 48*a*** are connected in 90 degree angular offset relationship to establish continuous drive.

Having thus described an illustrative embodiment of the invention, what is sought to be covered is best defined in the appended claims.

We claim:

1. A sheet receiver for printed sheets comprising: a frame structure supporting sheet distributor means, driven sheet infeed means for feeding sheets into said sheet distributor means, sheet guide means for receiving sheets supplied from said distributor means, and tray means for receiving sheets supplied from said guide means, said distributor means having an angularly movable sheet receiving distributor with a sheet inlet end located at said sheet infeed means for receiving sheets and an outlet end for passage of sheets fed into said distributor, drive means for positioning said distributor at selected angular positions of said sheet outlet end, said guide means having a plurality of fixed and angularly fanned sheet guides including plates radiating substantially from the center of angular movement of said sheet distributor with sheet inlet ends closely spaced for receiving sheets from said distributor and sheet outlet ends of increased angular space for delivery of sheets to said tray means, said sheet outlet ends of said guides terminating on a substantially vertical plane, said tray means including a set of sheet receiving trays spaced apart and having inlet ends located along said vertical plane to receive sheets from said sheet outlet ends of said guides, and driven sheet feeding roll means interposed between the outlet ends of said guides and the inlet ends of said trays.

2. Sheet receiver as defined in claim 1, said driven sheet infeed means being located substantially at the center of angular movement of said distributor.

3. Sheet receiver as defined in claim 1, said frame structure having means removably supporting said guide means for simultaneous removal from between said distributor means and said driven sheet feeding roll means at the inlet ends of said trays to facilitate jam clearance when said guide means is removed.

4. Sheet receiver as defined in claim 1, said sheet feeding roll means comprising pairs of driven rolls and nip rolls associated with each tray and means for driving said driven rolls including drive shafts for said driven rolls and locomotive drive means at opposite ends of said shafts.

* * * * *